US010029350B2

(12) United States Patent
Stockey et al.

(10) Patent No.: US 10,029,350 B2
(45) Date of Patent: *Jul. 24, 2018

(54) METHODS OF FORMING POLYCRYSTALLINE COMPACTS AND EARTH-BORING TOOLS INCLUDING POLYCRYSTALLINE COMPACTS

(71) Applicant: Baker Hughes Incorporated, Houston, TX (US)

(72) Inventors: David A. Stockey, The Woodlands, TX (US); Anthony A. DiGiovanni, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/995,766

(22) Filed: Jan. 14, 2016

(65) Prior Publication Data

US 2016/0158921 A1 Jun. 9, 2016

Related U.S. Application Data

(63) Continuation of application No. 14/221,097, filed on Mar. 20, 2014, and a continuation-in-part of (Continued)

(51) Int. Cl.
*B24D 3/02* (2006.01)
*B24D 18/00* (2006.01)
(Continued)

(52) U.S. Cl.
CPC ..... *B24D 18/00* (2013.01); *B24D 18/0009* (2013.01); *B24D 99/005* (2013.01);
(Continued)

(58) Field of Classification Search
USPC ..... 51/309, 293, 307
See application file for complete search history.

(56) References Cited

U.S. PATENT DOCUMENTS 3,482,075 A 12/1969 Wilde
3,597,578 A 8/1971 Sullivan et al.
(Continued)

FOREIGN PATENT DOCUMENTS

EP 0352895 A2 1/1990
EP 0541071 A1 5/1993
(Continued)

OTHER PUBLICATIONS

Ascarelli et al., Structural Modifications of Diamond Films Induced by Pulsed Laser Treatment, SPIE, vol. 3404, pp. 178-186, 1998.
(Continued)

*Primary Examiner* — James E McDonough
(74) *Attorney, Agent, or Firm* — TraskBritt

(57) ABSTRACT

Methods of forming polycrystalline compacts include subjecting a plurality of grains of hard material interspersed with a catalyst material to high-temperature and high-pressure conditions to form a polycrystalline material having intergranular bonds and interstitial spaces between adjacent grains of the hard material. The catalyst material is disposed in at least some of the interstitial spaces in the polycrystalline material. The methods further comprise substantially removing the catalyst material from the interstitial spaces in at least a portion of the polycrystalline material to form an at least partially leached polycrystalline compact; and removing a portion of the polycrystalline material from which the catalyst material has been substantially removed from the at least partially leached polycrystalline compact. The polycrystalline cutting elements may be secured to a bit body of an earth-boring tool.

17 Claims, 6 Drawing Sheets

Related U.S. Application Data application No. 12/265,462, filed on Nov. 5, 2008, now Pat. No. 9,259,803.

(60) Provisional application No. 60/985,339, filed on Nov. 5, 2007.

(51) Int. Cl.

| | |
|---|---|
| ***B24D 99/00*** | (2010.01) |
| ***E21B 10/567*** | (2006.01) |
| ***E21B 10/573*** | (2006.01) |
| *B24D 3/00* | (2006.01) |
| *B24D 11/00* | (2006.01) |
| *C09K 3/14* | (2006.01) |

(52) U.S. Cl.

CPC ..... *E21B 10/567* (2013.01); *E21B 10/5673* (2013.01); *E21B 10/5676* (2013.01); *E21B 10/5735* (2013.01)

(56) References Cited

U.S. PATENT DOCUMENTS 3,604,890 A 9/1971 Mullaney et al.
3,749,878 A 7/1973 Sullivan et al.
4,010,345 A 3/1977 Banas et al.
4,224,380 A 9/1980 Bovenkerk et al.
4,498,917 A 2/1985 Weinstein et al.
4,533,815 A 8/1985 Ecer
RE32,036 E 11/1985 Dennis
4,662,708 A 5/1987 Bagdal
4,694,139 A 9/1987 Roder
4,781,770 A 11/1988 Kar
4,827,947 A 5/1989 Hinz
4,847,112 A 7/1989 Halleux
4,987,800 A 1/1991 Gasan et al.
5,067,250 A 11/1991 Auweiler et al.
5,127,923 A 7/1992 Bunting et al.
5,149,936 A 9/1992 Walton, II
5,149,937 A 9/1992 Babel et al.
5,154,023 A 10/1992 Sioshansi
5,247,923 A 9/1993 Lebourg
5,286,006 A 2/1994 Ogura
5,366,522 A 11/1994 Nakamura et al.
5,447,208 A 9/1995 Lund et al.
5,483,038 A 1/1996 Ota et al.
5,504,303 A 4/1996 Nagy
5,554,415 A 9/1996 Turchan et al.
5,569,399 A 10/1996 Penney et al.
5,582,749 A 12/1996 Mori et al.
5,601,477 A 2/1997 Bunting et al.
5,653,300 A 8/1997 Lund et al.
5,697,994 A * 12/1997 Packer ..... C22C 26/00 428/332
5,734,146 A 3/1998 La Rocca
5,742,026 A 4/1998 Dickinson, Jr. et al.
5,776,220 A 7/1998 Allaire et al.
5,826,772 A 10/1998 Ariglio et al.
5,853,268 A 12/1998 Simpson
5,886,320 A 3/1999 Gallo et al.
5,944,129 A 8/1999 Jensen
5,962,071 A 10/1999 Reineck et al.
5,965,043 A 10/1999 Noddin et al.
5,967,250 A 10/1999 Lund et al.
6,000,483 A 12/1999 Jurewicz et al.
6,006,846 A 12/1999 Tibbitts et al.
6,023,040 A 2/2000 Zahavi et al.
6,119,335 A 9/2000 Park et al.
6,145,608 A 11/2000 Lund et al.
6,204,475 B1 3/2001 Nakata et al.
6,326,588 B1 12/2001 Neubauer et al.
6,353,204 B1 3/2002 Spaay et al.
6,423,928 B1 7/2002 Piwczyk
6,469,729 B1 10/2002 Ryan
6,489,589 B1 12/2002 Alexander
6,521,862 B1 2/2003 Brannon
6,559,413 B1 5/2003 Muenchausen et al.
6,562,698 B2 5/2003 Manor
6,590,181 B2 7/2003 Choo et al.
6,596,225 B1 7/2003 Pope et al.
6,601,662 B2 8/2003 Matthias et al.
6,605,798 B1 8/2003 Cullen
6,655,845 B1 12/2003 Pope et al.
6,766,870 B2 7/2004 Overstreet
6,779,951 B1 8/2004 Vale et al.
6,844,521 B2 1/2005 Staufer et al.
6,845,635 B2 1/2005 Watanabe et al.
6,969,822 B2 11/2005 Pollard
7,022,941 B2 4/2006 Joseph et al.
7,065,121 B2 6/2006 Filgas et al.
7,163,875 B2 1/2007 Richerzhagen
7,188,692 B2 3/2007 Lund et al.
7,294,807 B2 11/2007 Callies et al.
7,323,699 B2 1/2008 Hopkins et al.
7,712,553 B2 5/2010 Shamburger
7,730,977 B2 6/2010 Achilles
7,757,792 B2 7/2010 Shamburger
8,010,224 B2 8/2011 Yamaguchi et al.
8,651,204 B2 2/2014 Webb
8,684,112 B2 4/2014 DiGiovanni et al.
8,839,889 B2 9/2014 DiGiovanni et al.
8,919,462 B2 12/2014 DiGiovanni et al.
8,925,655 B1 1/2015 Sani et al.
8,991,525 B2 3/2015 Bilen et al.
9,103,174 B2 8/2015 DiGiovanni
2002/0104831 A1 8/2002 Chang et al.
2002/0148819 A1 10/2002 Maruyama et al.
2003/0000928 A1 1/2003 Forlong
2004/0163854 A1 8/2004 Lund et al.
2004/0198028 A1 10/2004 Tanaka et al.
2004/0206734 A1 10/2004 Horsting
2004/0238226 A1* 12/2004 Lin ..... F16J 15/3496 175/371
2005/0241446 A1 11/2005 Joseph
2006/0043622 A1 3/2006 Kumazawa et al.
2006/0060387 A1 3/2006 Overstreet et al.
2006/0070982 A1 4/2006 Patel
2006/0138097 A1 6/2006 Hiramatsu
2006/0180354 A1 8/2006 Belnap et al.
2006/0247769 A1 11/2006 Molz et al.
2006/0272571 A1 12/2006 Cho
2008/0115421 A1* 5/2008 Sani ..... B22F 7/08 51/295
2009/0114628 A1 5/2009 DiGiovanni
2009/0313908 A1 12/2009 Zhang et al.
2010/0011673 A1 1/2010 Shamburger
2011/0042148 A1 2/2011 Schmitz et al.
2011/0258936 A1 10/2011 DiGiovanni
2012/0048625 A1 3/2012 Bellin
2012/0103698 A1 5/2012 DiGiovanni
2012/0151847 A1 6/2012 Ladi et al.
2012/0152064 A1 6/2012 Ladi et al.
2012/0211284 A1 8/2012 DiGiovanni
2012/0325563 A1* 12/2012 Scott ..... E21B 10/567 175/428
2013/0068534 A1 3/2013 DiGiovanni et al.
2013/0068537 A1 3/2013 DiGiovanni
2013/0068538 A1 3/2013 DiGiovanni et al.
2013/0291442 A9 11/2013 Zhang et al.
2014/0134403 A1 5/2014 Gledhill
2014/0166371 A1 6/2014 Whittaker
2014/0366456 A1 12/2014 Chapman et al.
2015/0021100 A1 1/2015 Cheng
2015/0266163 A1 9/2015 Stockey et al.

FOREIGN PATENT DOCUMENTS

EP 1844891 A1 10/2007
WO 09804382 A1 2/1998

(56) References Cited

FOREIGN PATENT DOCUMENTS

| | | | |
|---|---|---|---|
| WO | 0037208 | A1 | 6/2000 |
| WO | 2006038017 | A2 | 4/2006 |
| WO | 2012145586 | A1 | 10/2012 |

OTHER PUBLICATIONS

Chao et al., Investigation of Laser Ablation of CVD Diamond Film, Proc. of SPIE, vol. 5713, pp. 21-28, 2005.
Eder, Kurt, Dies, New thoughts on machinery for synthetic PCD die piercing and profiling, Wire Journal International, pp. 34-40, Dec. 1984.
Erasmus et al., Application of Raman Spectroscopy to Determine Stress in Polycrystalline Diamond Tools as a Function of Tool Geometry and Temperature, Diamond & Related Materials, vol. 20, (2011), pp. 907-911.
Gloor et al., Laser ablation of diamond films in various atmospheres, Diamond and Related Materials, vol. 7, pp. 607-611, 1998.
Harrison et al., Enhanced Cutting of Polycrystalline Diamond with a Q-Switched Diode Pumped Solid State Laser, Powerlase Ltd., Paper #202, 8 pages, http://www.powerlase-photonics.com/wp-content/uploads/2011/data-sheets/ICALEO2005_PCDPaper.pdf., 2005.
Harrison et al., Laser Processing of Polycrystalline Diamond, Tungsten Carbide and a Related Composite Material, Journal of Laser Applications, vol. 18, issue 2, pp. 117-126, May 2006.
Karpuschewski et al., Laser Machining of Cobalt Cemented Tungsten Carbides, Towards Synthesis of Micro-/Nano-systems: The 11th International Conference on Precision Engineering (ICPE) Aug. 16-18, 2006, pp. 243-248.
Khomich et al., ptical properties of laser-modified diamond surface, SPIE, vol. 3484, pp. 166-174, 1998.
Kim et al., Microroughness Reduction of Tungsten Films by Laser Polishing Technology with a Line Beam, Japanese Journal of Applied Physics, vol. 43, No. 4A, pp. 1315-1322, 2004.
Kiwus, Ulrich, Grinding and polishing of diamond wire dies with ultra-hard, ready-made needles and direct ultrasound generators, Wire, vol. 42, pp. 98-99, Feb. 1992.
Kononenko et al., Control of laser machining of polycrystalline diamond plates by the method of low-coherence optical interferometry, Quantum Electronics, vol. 35, No. 7, pp. 622-626, Jul. 2005.
Konov et al., Laser microprocessing of diamond and diamond-like films, SPIE vol. 2045, pp. 184-192, 1994.
Laguarta et al., Laser application for optical glass polishing, SPIE, vol. 2775, pp. 603-610, 1996.
Levy, Aron, Drilling, Sawing, and Contouring Industrial and Gem Diamonds by Laser, pp. 223-236, no publication info or date.
Li et al., In Situ Diagnosis of Pulsed UV Laser Surface Ablation of Tungsten Carbide Hardmetal by Using Laser-Induced Optical Emission Spectrosopy, Applied Surface Science, vol. 185, (2001), pp. 114-122.
Li et al., Laser-Induced Breakdown Spectroscopy for On-Line Control of Selective Removal of Cobalt Binder from Tungsten Carbide Hardmetal by Pulsed UV Laser Surface Ablation, Applied Surface Science, vol. 181, (2001), pp. 225-233.
Meijer et al., Laser Machining by short and ultrashort pulses, state of the art and new opportunities in the age of the photons, 20 pages, CIRP Annals—Manufacturing Technology, 2002.
Meijer, Johan, Laser beam machining (LBM), state of the art and new opportunities Journal of Materials Processing Technology, vol. 149, pp. 2-17, 2004.
Murahara, Masataka, Excimer Laser-Induced Photochemical Polishing of SiC Mirror, Proc. SPIE, vol. 4679, pp. 69-74, 2002.
Nowak et al., A model for "cold" laser ablation of green state ceramic materials, Appl. Phys. A, vol. 91, pp. 341-348, 2008.
Pimenov et al., Laser Polishing of Diamond Plates, Appl. Phys. A, vol. 69, pp. 81-88, 1999.
Quintero et al., Optimization of an off-axis nozzle for assist gas injection in laser fusion cutting, Optics and Lasers in Engineering, vol. 44, pp. 1158-1171, 2006.
Reimer, Craig, Stay Cool! New PDC Cutter Improves ROP, Tallys, hggp://tallys.ca/stay-cool-new-pdc-cutter-improves-rop/, visited Feb. 27, 2014, 1 page.
Scott et al., PDC Cutter Geometry Improves ROP, Increases Footage Drilled by 37%, http://www.drillingcontractor.org, Posted Dec. 11, 2013, 5 pages.
Smith, Maurice, Drilling & Completions, Culling Edge, PDC Bits Increasingly Displace Roller Cone Bits as Technology Rapidly Evolves, New Technology Magazine, 8 pages, Jan./Feb. 2005.
SPE, Faster and Longer Bit Runs With New-Generation PDC Cutter, JPT, pp. 73-75, Dec. 2006.
SPE, New Bit Design and Cutter Technology Extend PDC Applications to Hard-Rock Drilling, JPT, pp. 63-64, Dec. 2005.
Stockey et al., U.S. Appl. No. 14/329,380, titled Cutting Elements Comprising Partially Leached Polycrystalline Material Tools Comprising Such Cutting Elmements, and Methods of Forming Wellbores Using Such Cutting Elements, filed Jul. 11, 2014.
Underwood, Quantitative Stereology, 103 105 (Addison-Wesley Publishing Company, Inc., 1970).
Watson et al., Using New Computational Fluid Dynamics Techniques to Improve PDC Bit Performance, SPE/IADC 37580, pp. 91-105, 1997.
Windholz et al., Nanosecond pulsed excimer laser machining of chemical vapour deposited diamond and highly oriented pyrolytic graphite, Part I, an experimental investigation Journal of Materials Science, vol. 32, pp. 4295-4301, 1997.
Xu et al., Study on Energy Density Needed in ND:YAG Laser Polishing of CVD Diamond Thick-Film, 7th International Conference on Progress of Machining Technology, pp. 382-387, Dec. 8-11, 2004.
Zhang et al., An Experimental Study on Laser Cutting Mechanisms of Polycrystalline Diamond Compacts, Annals of the CIRP, vol. 56, No. 1, pp. 201-204, 2007.

* cited by examiner

METHODS OF FORMING POLYCRYSTALLINE COMPACTS AND EARTH-BORING TOOLS INCLUDING POLYCRYSTALLINE COMPACTS

CROSS-REFERENCE TO RELATED APPLICATIONS

This application is a continuation of U.S. patent application Ser. No. 14/221,097, filed Mar. 20, 2014, pending, and is a continuation-in-part of U.S. patent application Ser. No. 12/265,462, filed Nov. 5, 2008, now U.S. Pat. No. 9,259,803, issued Feb. 16, 2016, which is a utility conversion of U.S. Provisional Patent Application Ser. No. 60/985,339, filed Nov. 5, 2007, the disclosure of each of which is hereby incorporated herein in its entirety by this reference.

FIELD

Embodiments of the present disclosure relate generally to polycrystalline compacts and methods of processing polycrystalline compacts.

BACKGROUND

Earth-boring tools for forming wellbores in subterranean earth formations may include a plurality of cutting elements secured to a body. For example, a fixed-cutter earth-boring rotary drill bit (also referred to as a "drag bit") includes a plurality of cutting elements fixedly attached to a bit body of the drill bit. Similarly, roller cone earth-boring rotary drill bits include cones mounted on bearing pins extending from legs of a bit body such that each cone is capable of rotating about the bearing pin on which the cone is mounted. A plurality of cutting elements may be mounted to each cone of the drill bit.

The cutting elements used in such earth-boring tools often include polycrystalline diamond cutters (often referred to as "PDCs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as cobalt, iron, nickel, or alloys or mixtures thereof) to form a layer of polycrystalline diamond material on a cutting element substrate. These processes are often referred to as "high pressure, high temperature" (or "HPHT") processes. The cutting element substrate may be a cermet material (i.e., a ceramic-metal composite material) such as cobalt-cemented tungsten carbide. In such instances, the cobalt or other catalyst material in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HPHT process. After sintering, portions of the PCD material may be polished or shaped to form the cutting elements. For example, an edge of the PCD material may be ground to form a chamfer.

Cobalt, which is commonly used in sintering processes to form PCD material, melts at about 1495° C. The melting temperature may be reduced by alloying cobalt with carbon or another element, so HPHT sintering of cobalt-containing bodies may be performed at temperatures above about 1450° C.

Upon formation of a diamond table using an HPHT process, catalyst material may remain in interstitial spaces between the grains or crystals of diamond in the resulting polycrystalline diamond table. The presence of the catalyst material in the diamond table may contribute to thermal damage in the diamond table when the cutting element is heated during use, due to friction at the contact point between the cutting element and the formation. Polycrystalline diamond cutting elements in which the catalyst material remains in the diamond table are generally thermally stable up to temperatures of about 750° C., although internal stress within the polycrystalline diamond table may begin to develop at temperatures exceeding about 350° C. This internal stress is at least partially due to differences in the rates of thermal expansion between the diamond table and the cutting element substrate to which it is bonded. This differential in thermal expansion rates may result in relatively large compressive and tensile stresses at the interface between the diamond table and the substrate, and may cause the diamond table to delaminate from the substrate. At temperatures of about 750° C. and above, stresses within the diamond table may increase significantly due to differences in the coefficients of thermal expansion of the diamond material and the catalyst material within the diamond table itself. For example, cobalt thermally expands significantly faster than diamond, which may cause cracks to form and propagate within a diamond table including cobalt, eventually leading to deterioration of the diamond table and ineffectiveness of the cutting element.

To reduce the problems associated with different rates of thermal expansion in polycrystalline diamond cutting elements, so called "thermally stable" polycrystalline diamond (TSD) cutting elements have been developed. Such a thermally stable polycrystalline diamond cutting element may be formed by leaching the catalyst material (e.g., cobalt) out from interstitial spaces between the diamond grains in the diamond table using, for example, an acid. All of the catalyst material may be removed from the diamond table, or only a portion may be removed. Thermally stable polycrystalline diamond cutting elements in which substantially all catalyst material has been leached from the diamond table have been reported to be thermally stable up to temperatures of about 1200° C. It has also been reported, however, that fully leached diamond tables are relatively more brittle and vulnerable to shear, compressive, and tensile stresses than are non-leached diamond tables. In an effort to provide cutting elements having diamond tables that are more thermally stable relative to non-leached diamond tables, but that are also relatively less brittle and vulnerable to shear, compressive, and tensile stresses relative to fully leached diamond tables, cutting elements have been provided that include a diamond table in which catalyst material has been substantially leached from only a portion of the diamond table.

BRIEF SUMMARY

A method of forming a polycrystalline compact includes subjecting a plurality of grains of hard material interspersed with a catalyst material to high-temperature and high-pressure conditions to form a polycrystalline material having intergranular bonds and interstitial spaces between adjacent grains of the hard material. The catalyst material is disposed in at least some of the interstitial spaces in the polycrystalline material. The method further comprises substantially removing the catalyst material from the interstitial spaces in at least a portion of the polycrystalline material to form an at least partially leached polycrystalline compact. The method comprises removing a portion of the polycrystalline material from which the catalyst material has been substantially removed from the at least partially leached polycrystalline compact.

A method of forming an earth-boring tool includes forming a polycrystalline cutting element and securing the polycrystalline cutting element to a bit body. The polycrystalline cutting element may be formed by subjecting a plurality of grains of hard material interspersed with a catalyst material to high-temperature and high-pressure conditions to form a polycrystalline material having intergranular bonds and interstitial spaces between adjacent grains of the hard material. The catalyst material is disposed in at least some of the interstitial spaces in the polycrystalline material. The method further comprises substantially removing the catalyst material from the interstitial spaces in at least a portion of the polycrystalline material to form an at least partially leached polycrystalline compact and removing a portion of the polycrystalline material from which the catalyst material has been substantially removed from the at least partially leached polycrystalline compact.

A method of forming a polycrystalline diamond compact includes subjecting a plurality of diamond grains and a metal catalyst material to high-temperature and high-pressure conditions to form a diamond table having intergranular bonds and interstitial spaces between adjacent diamond grains. The metal catalyst material is disposed in at least some of the interstitial spaces in the diamond table. The method may further comprise leaching the catalyst material from the interstitial spaces in a first portion of the diamond table to form a partially leached diamond table, mechanically removing a portion of the diamond grains from the first portion of the partially leached diamond table, and leaching the catalyst material from the interstitial spaces in a second portion of the diamond table.

BRIEF DESCRIPTION OF THE DRAWINGS

While the specification concludes with claims particularly pointing out and distinctly claiming what are regarded as embodiments of the present disclosure, various features and advantages of embodiments of the disclosure may be more readily ascertained from the following description of example embodiments of the disclosure when read in conjunction with the accompanying drawings, in which:

DETAILED DESCRIPTION

Figure 1:
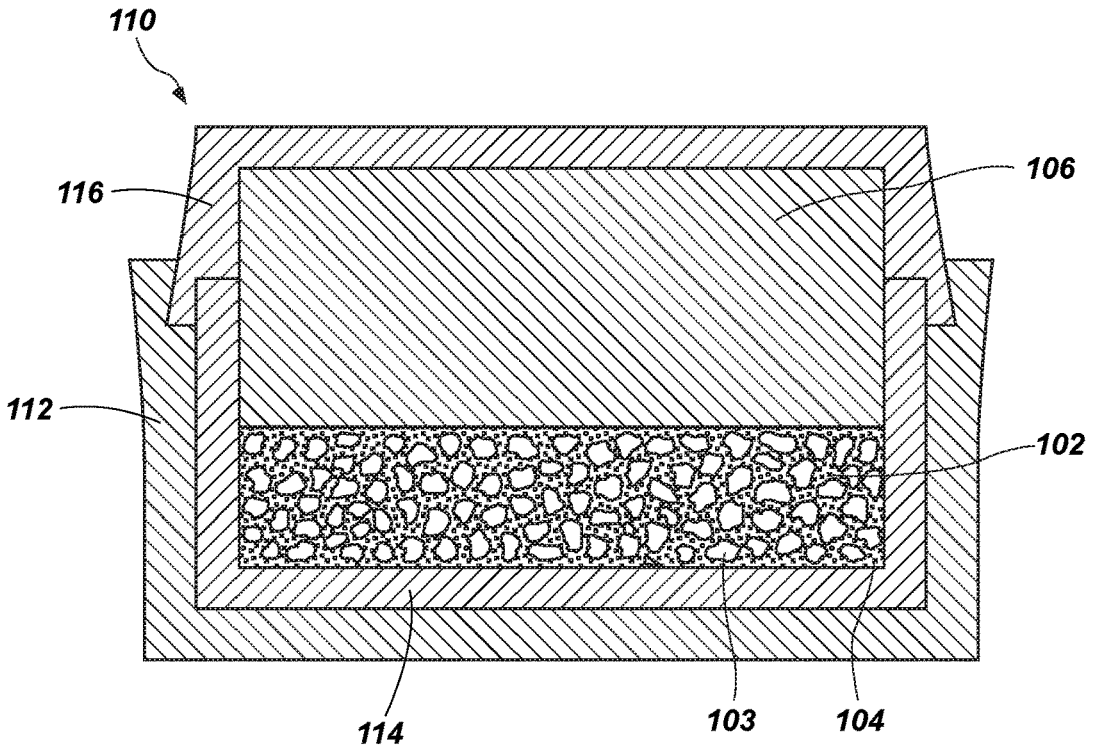
FIG. 1 is a simplified cross-sectional side view illustrating a method of forming a polycrystalline compact according to the present disclosure.

The illustrations presented herein are not actual views of any particular material, apparatus, system, or method, but are merely idealized representations that are employed to describe example embodiments of the present disclosure. Additionally, elements common between figures may retain the same numerical designation.

Polycrystalline compacts may be formed by subjecting grains of hard material and a catalyst to high-temperature and high-pressure (HTHP) conditions to form intergranular bonds. A portion of the catalyst material may then be removed, and the compacts may be shaped, polished, or otherwise processed after removal of some of the catalyst material.

As used herein, the term "drill bit" means and includes any type of bit or tool used for drilling during the formation or enlargement of a wellbore and includes, for example, rotary drill bits, percussion bits, core bits, eccentric bits, bi-center bits, reamers, expandable reamers, mills, drag bits, roller cone bits, hybrid bits, and other drilling bits and tools known in the art.

As used herein, the term "hard material" means and includes any material having a Knoop hardness value of about 3,000 $Kg_f/mm^2$ (29,420 MPa) or more. Hard materials include, for example, diamond and cubic boron nitride.

As used herein, the term "intergranular bond" means and includes any direct atomic bond (e.g., covalent, metallic, etc.) between atoms in adjacent grains of material.

The term "polycrystalline material" means and includes any material comprising a plurality of grains (i.e., crystals) of the material that are bonded directly together by intergranular bonds. The crystal structures of the individual grains of the material may be randomly oriented in space within the polycrystalline material.

As used herein, the term "polycrystalline compact" means and includes any structure comprising a polycrystalline material formed by a process that involves application of pressure (e.g., compaction) to the precursor material or materials used to form the polycrystalline material.

As used herein, the term "grain size" means and includes a geometric mean diameter measured from a two-dimensional section through a bulk material. The geometric mean diameter for a group of particles may be determined using techniques known in the art, such as those set forth in Ervin E. Underwood, Quantitative Stereology, 103-105 (Addison-Wesley Publishing Company, Inc., 1970), the disclosure of which is incorporated herein in its entirety by this reference.

As used herein, the term "catalyst material" refers to any material that is capable of substantially catalyzing the formation of intergranular bonds between grains of hard material during an HTHP process but at least partially contributes to the degradation of the intergranular bonds and granular material under elevated temperatures, pressures, and other conditions that may be encountered in a drilling operation for forming a wellbore in a subterranean formation. For example, catalyst materials for diamond include, by way of example only, cobalt, iron, nickel, other elements from Group VIIIA of the Periodic Table of the Elements, and alloys thereof.

As used herein, the term "leaching" means and includes removing or extracting materials from a solid material (such as a polycrystalline material) into a carrier, such as by dissolving the materials into the carrier or by converting the materials into a salt.

As used herein with regard to a depth or level, or magnitude of a depth of level, beneath a surface of a polycrystalline compact, the terms "substantially uniform" and "substantially uniformly" mean and include a depth of an area under the surface which is substantially devoid of significant aberrations such as spikes and/or valleys in excess of a general magnitude of such depth. More specifically, a "substantially uniform depth" when referring to a depth of catalyst removal beneath a surface of a polycrystalline compact means and includes a depth of such removal substantially free of significant aberrations such as spikes, valleys and other variations in the region below the surface. In other words, if catalyst is removed to a substantially uniform depth below, for example, a cutting face of a polycrystalline compact, the catalyst is removed from an area below the surface of the cutting face to a depth, the boundary of which with a remainder of the compact including such catalyst while not necessarily constant, is substantially free of significant aberrations such as spikes, valleys and/or other variations.

FIG. 1 illustrates materials and devices that may be used in a method of forming a polycrystalline compact. A mixture 102 of a hard material 103, specifically diamond in this embodiment, interspersed with a catalyst 104 is placed into a container 110. The container 110 may be a canister used for HPHT processing to form polycrystalline compacts, and may include one or more generally cup-shaped members, such as an outer cup-shaped member 112, an inner cup-shaped member 114, and a cup-shaped cap member 116, which may be assembled and swaged and/or welded together to form the container 110. The mixture 102 and an optional cutting element substrate 106 may be disposed within the inner cup-shaped member 114, which may have a circular end wall and a generally cylindrical lateral side wall extending perpendicularly from the circular end wall, such that the inner cup-shaped member 114 is generally cylindrical and includes a first closed end and a second, opposite open end.

The hard material 103 may be in the form or crystals of various sizes, such as micron- and/or submicron-sized hard material. The grains of the hard material 103 may form a hard polycrystalline material after sintering. The hard material 103 may include, for example, diamond, cubic boron nitride, etc. The catalyst 104 may include, for example and without limitation, cobalt, iron, nickel, or an alloy or mixture thereof. The catalyst 104 may be formulated to promote the formation of intergranular bonds during sintering.

To form a polycrystalline hard material in an HTHP process, the mixture 102 may be subjected to elevated temperatures (e.g., temperatures greater than about 1,000° C.) and elevated pressures (e.g., pressures greater than about 5.0 gigapascals (GPa)). These conditions may promote the formation of intergranular bonds between the grains of the hard material 103. In some embodiments, the mixture 102 may be subjected to a pressure greater than about 6.0 GPa, greater than about 8.0 GPa, or even greater than about 10.0 GPa. The mixture 102 may be subjected to a temperature in the HTHP process from about 1,200° C. to about 2,000° C., such as a temperature greater than about 1,500° C. HTHP conditions may be maintained for a period of time from about thirty (30) seconds to about sixty (60) minutes to sinter the particles and form a polycrystalline hard material.

In some embodiments, the mixture 102 may include a powder or a powder-like substance. In other embodiments, however, the mixture 102, which may comprise a solution, slurry, gel, or paste, may be processed by (e.g., on or in) another material form, such as a tape or film, which, after stacking to a selected thickness, and undergoing subsequent thermal and or chemical processes to remove the one or more organic processing aids, may be subjected to an HTHP process. One or more organic materials (e.g., processing aids) also may be included with the particulate mixture to facilitate processing. For example, some suitable materials are described in U.S. Patent Application Publication No. US 2012/0211284 A1, published Aug. 23, 2012, and titled "Methods of Forming Polycrystalline Compacts, Cutting Elements and Earth-Boring Tools," the disclosure of which is incorporated herein in its entirety by this reference.

Figure 2:
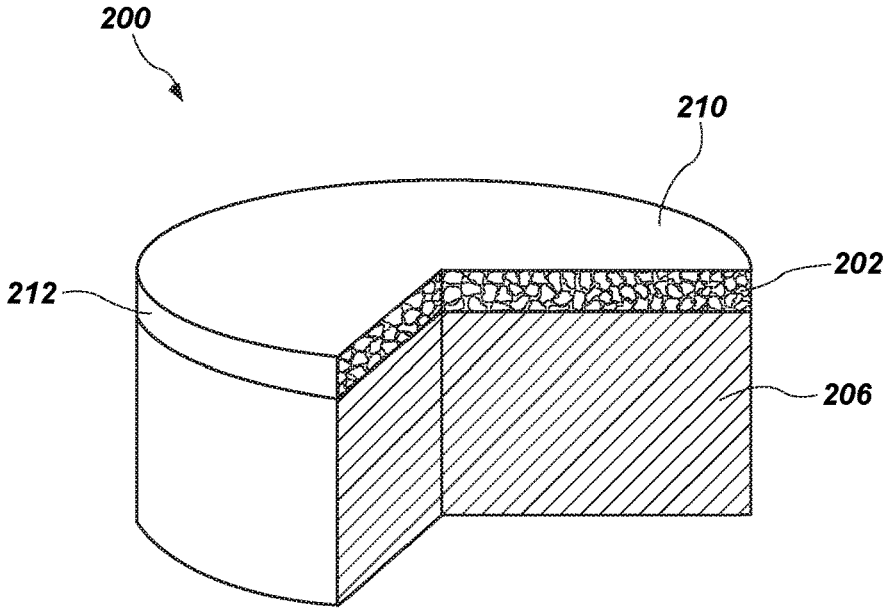
FIG. 2 is a partial cutaway view showing a polycrystalline compact.

FIG. 2 shows a polycrystalline compact 200 having intergranular bonds and interstitial spaces formed between adjacent grains of the hard material 103 during sintering. The polycrystalline compact 200 includes a polycrystalline table 202 and an optional substrate 206. The polycrystalline table 202 may include surfaces 210, 212 corresponding to inner surfaces of the container 110 used to form the polycrystalline compact 200. The polycrystalline table 202 and substrate 206 may be formed from the mixture 102 and the substrate 106, respectively, as shown in FIG. 1.

Figure 3:
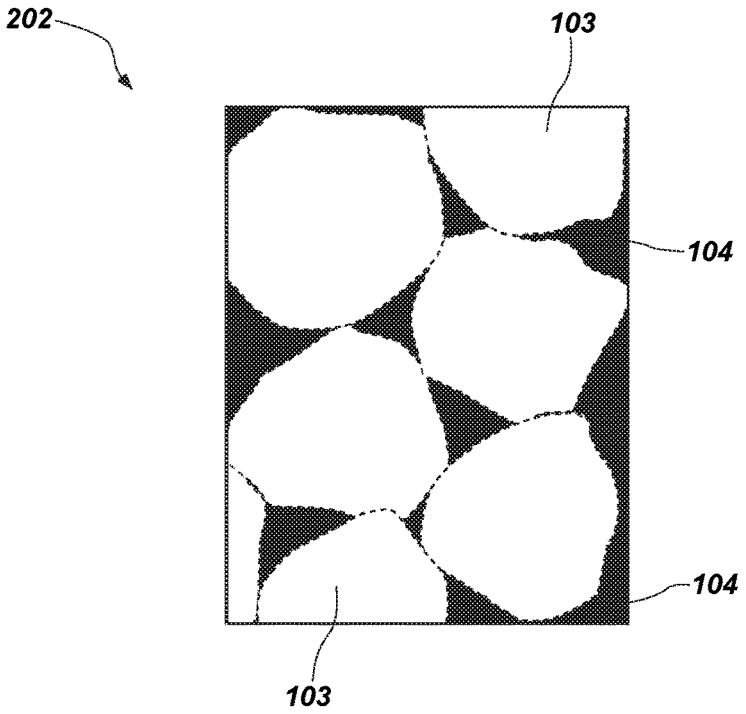
FIG. 3 is a simplified drawing showing how a microstructure of the polycrystalline compact of FIG. 2 may appear under magnification, and illustrates inter-bonded and interspersed grains of hard material.

FIG. 3 illustrates how a portion of the polycrystalline table 202 shown in FIG. 2 may appear under further magnification. The catalyst 104 may be disposed in at least some of the interstitial spaces in the polycrystalline compact 200 formed between grains of hard material 103 during sintering.

Figure 4:
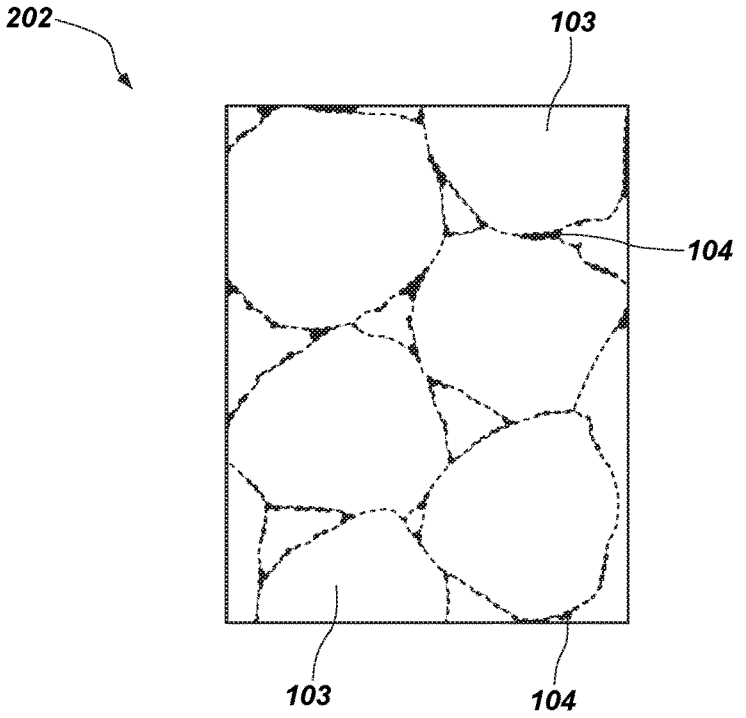
FIG. 4 is a simplified drawing showing how the microstructure of FIG. 3 may appear after removal of catalyst material.

After sintering the mixture 102 to form the polycrystalline table 202, at least a portion of the catalyst 104 may be removed from the interstitial spaces in the polycrystalline table 202 to form an at least partially leached polycrystalline compact. FIG. 4 illustrates a portion of the polycrystalline table 202 after removal of catalyst 104. The portion of the polycrystalline table 202 shown in FIG. 4 corresponds to the portion of the polycrystalline table 202 shown in FIG. 3. In some embodiments, some catalyst 104 may remain within the interstitial spaces. The catalyst 104 may be substantially or entirely removed from all or a portion of the polycrystalline table 202.

Removal of the catalyst 104 may be performed by conventional means, such as by placing the polycrystalline compact in an acid bath. Such a process may be referred to in the art as leaching or acid-leaching. By way of example and not limitation, the polycrystalline table 202 may be leached using a leaching agent and processes such as those described more fully in, for example, U.S. Pat. No. 5,127,923, issued Jul. 7, 1992, and titled "Composite Abrasive Compact Having High Thermal Stability;" and U.S. Pat. No. 4,224,380, issued Sep. 23, 1980, and titled "Temperature Resistant Abrasive Compact and Method for Making Same;" the disclosure of each of which patent is incorporated herein in its entirety by this reference. Specifically, aqua regia (a mixture of concentrated nitric acid ($HNO_3$) and concentrated hydrochloric acid (HCl)) may be used to at least substantially remove catalyst material from the interstitial spaces between the inter-bonded grains of hard material in the polycrystalline table 202. It is also known to use boiling hydrochloric acid (HCl) and boiling hydrofluoric acid (HF) as leaching agents. One particularly suitable leaching agent is hydrochloric acid (HCl) at a temperature of above 110° C., which may be provided in contact with the hard material of the polycrystalline table 202 for a period of about two hours to about sixty hours, depending upon the size of the body comprising the hard material. After leaching the hard material, the interstitial spaces between the inter-bonded grains within the hard material may be at least substantially free of catalyst material used to catalyze formation of intergranular bonds between the grains in the hard polycrystalline material. In some embodiments, leaching may be selectively applied to specific regions of the polycrystalline table 202, and not to other regions. For example, in some embodiments, a mask may be applied to a region of the polycrystalline table 202, and only the unmasked regions may be leached.

Other methods of removing catalyst material are described in U.S. Pat. Application Pub. 2011/0258936, published Oct. 27, 2011, and titled "Methods of Forming Polycrystalline Compacts," the disclosure of which is incorporated herein in its entirety by this reference.

The catalyst 104 may be substantially removed from a volume of the polycrystalline table 202 to a substantially uniform depth from surfaces 210, 212 (FIG. 2) of the polycrystalline table 202. In such embodiments, an interface may be formed between a volume of the polycrystalline table 202 from which catalyst 104 has been leached and a volume of the polycrystalline table 202 from which catalyst 104 has not been leached. In some embodiments, the catalyst 104 may be substantially removed from within 1.0 mm, within 0.7 mm, within 0.5 mm, within 0.25 mm, within 0.1 mm, or even within 0.01 mm of the surfaces 210, 212.

After the catalyst 104 has been substantially removed from at least a portion of the polycrystalline table 202, a portion of the hard material 103 may be removed from the polycrystalline table 202. For example, a volume of leached hard polycrystalline material may be removed from the polycrystalline table 202 to improve cutting performance of the polycrystalline compact 200. In some embodiments, removal may include polishing or smoothing of one or more surfaces 210, 212 (FIG. 2) of the polycrystalline table 202, such as by methods described in U.S. Pat. No. 6,145,608, issued Nov. 14, 2000, and titled "Superhard Cutting Structure Having Reduced Surface Roughness and Bit for Subterranean Drilling so Equipped;" U.S. Pat. No. 5,653,300, issued Aug. 5, 1997, and titled "Modified Superhard Cutting Elements Having Reduced Surface Roughness Method of Modifying, Drill Bits Equipped with Such Cutting Elements, and Methods of Drilling Therewith;" and U.S. Pat. No. 5,447,208, issued Sep. 5, 1995, and titled "Superhard Cutting Element Having Reduced Surface Roughness and Method of Modifying;" the disclosure of each of which is incorporated herein in its entirety by this reference.

For example, surfaces 210, 212 may be polished to have a surface finish with irregularities or roughness (measured vertically from the surface) less than about 10 μin. (about 0.254 μm) RMS (root mean square). In further embodiments, the polycrystalline table 202 may have a surface roughness less than about 2 μin. (about 0.0508 μm) RMS. In yet further embodiments, the polycrystalline table 202 may have a surface roughness less than about 0.5 μin. (about 0.0127 μm) RMS, approaching a true "mirror" finish. The foregoing surface roughness measurements of the polycrystalline table 202 may be measured using a calibrated HOMMEL® America Model T 4000 diamond stylus profilometer contacting the surface of the polycrystalline table 202.

In some embodiments, portions of the hard material 103 may be removed from the polycrystalline table 202 to form shaped surfaces on the polycrystalline compact 200. For example, the polycrystalline table 202 may be machined or otherwise shaped to form non-planar surfaces, such as described in U.S. Patent Publication 2012/0103698, published May 3, 2012, and titled "Cutting Elements, Earth-boring Tools Incorporating Such Cutting Elements, and Methods of Forming Such Cutting elements;" U.S. Patent Publication 2013/0068534, published Mar. 21, 2013, and titled "Cutting Elements for Earth-boring Tools, Earth-boring Tools Including Such Cutting Elements and Related Methods;" U.S. Patent Publication 2013/0068537, published Mar. 21, 2013, and titled "Cutting Elements for Earth-boring Tools, Earth-boring Tools Including Such Cutting Elements and Related Methods;" U.S. Patent Publication 2013/0068538, published Mar. 21, 2013, and titled "Cutting Elements for Earth-boring Tools, Earth-boring Tools Including Such Cutting Elements, and Related Methods;" the entire disclosure of each of which are incorporated herein in their entirety by this reference.

Figure 5:
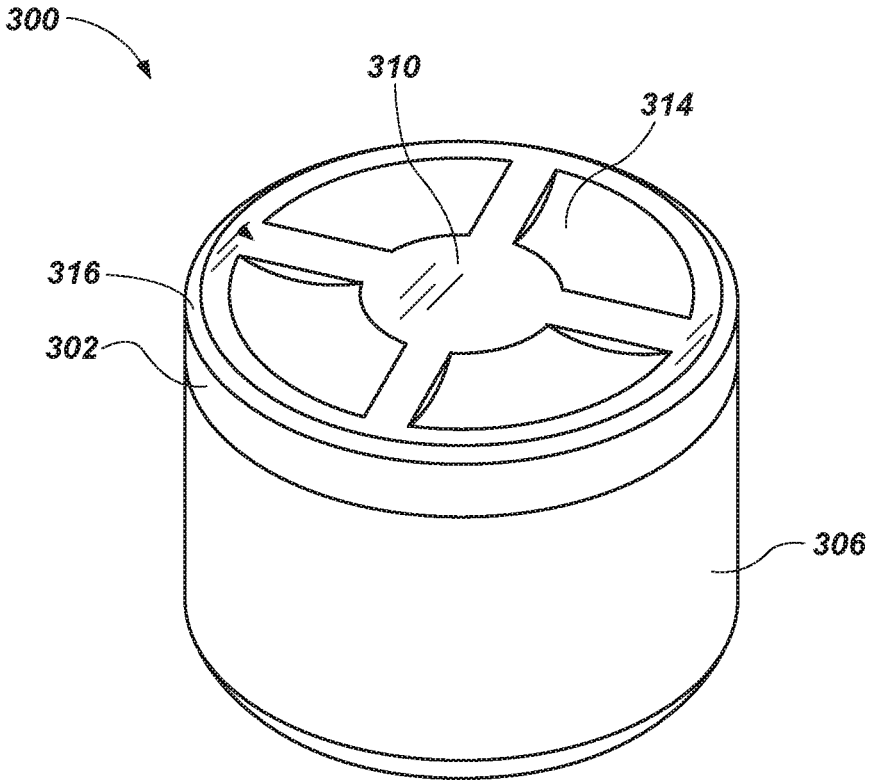
FIG. 5 is simplified drawing showing a perspective view of a polycrystalline compact having a cutting surface with non-planar portions.

In some embodiments, one or more recesses may be formed that extend into a surface of the polycrystalline table 202. For example, FIG. 5 illustrates a perspective view of a polycrystalline compact 300, which may be formed as described above with respect to the polycrystalline compact 200 shown in FIG. 2.

Figure 6:
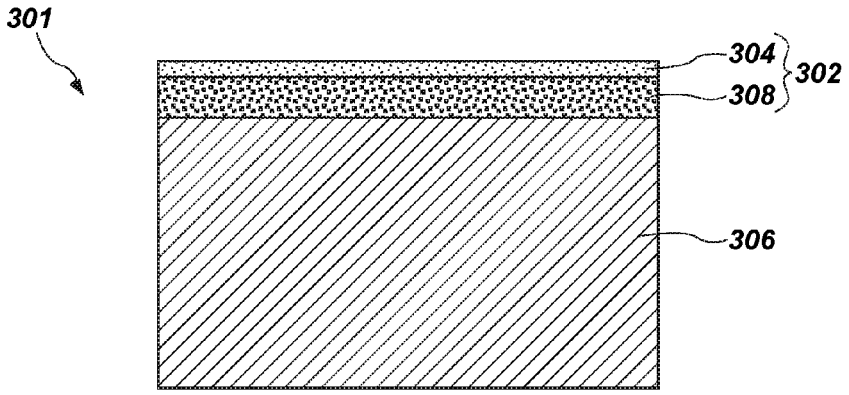
FIGS. 6 through 8 are simplified cross-sectional side views of partially formed polycrystalline compacts during processing, such as partially formed polycrystalline compacts used to form the polycrystalline compact shown in FIG. 5.
Figure 7:
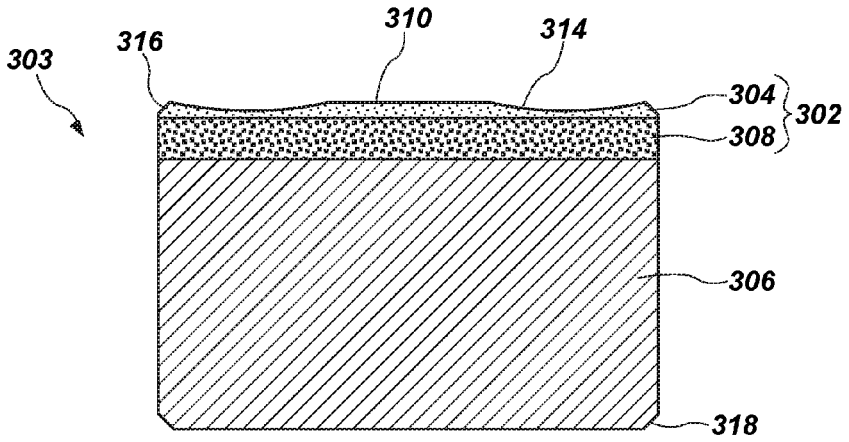
Figure 8:
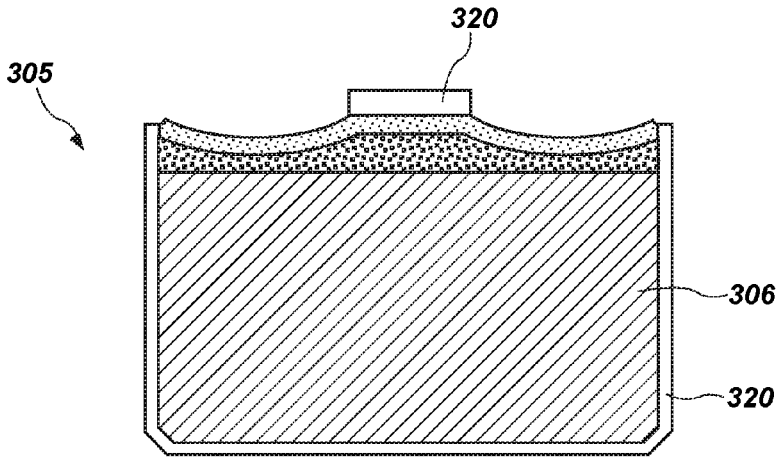

The polycrystalline compact 300 may be formed as illustrated in FIGS. 6 through 8. FIG. 6 illustrates a partially formed polycrystalline compact 301 having a polycrystalline table 302 and a substrate 306. The polycrystalline table 302 may be at least partially leached to substantially remove catalyst material from interstitial spaces between polycrystalline material. That is, substantially all the catalyst may be removed from a leached portion 304 of the polycrystalline table 302, and catalyst may remain in an unleached portion 308 of the polycrystalline table 302.

FIG. 7 illustrates a partially formed polycrystalline compact 303 having recesses 314 formed in the polycrystalline table 302 after leaching the catalyst from a portion of the polycrystalline table 302. For example, the recesses 314 are formed in a front cutting face 310. Thus, the front cutting face 310 includes one or more non-planar surfaces. The front cutting face 310 may be polished after leaching, as previously described. A chamfer surface 316 may be formed after leaching, such as by exposing the polycrystalline table 302 to an energy beam (e.g., a beam of electromagnetic radiation, such as a laser), as described in U.S. Patent Publication 2009/0114628, published May 7, 2009, and titled "Methods and Apparatuses for Forming Cutting Elements Having a Chamfered Edge for Earth-boring Tools," the disclosure of which is incorporated herein in its entirety by this reference. A chamfer 318 may also be formed on the substrate 306 on an end opposite the polycrystalline table 302.

FIG. 8 illustrates a partially formed polycrystalline compact 305 having a masking material 320 covering a portion of the polycrystalline table 302 and/or the substrate 306. The masking material 320 may be an impermeable material, such as a wax, an epoxy, etc. The partially formed polycrystalline compact 305 may then be leached again to remove additional catalyst material. The masking material 320 may limit or prevent leaching over areas of the partially formed polycrystalline compact 305 covered by the masking material 320. Thus, in the subsequent leaching, removal of the catalyst material may be limited to selected areas, such as those areas over which polycrystalline material has been removed. For example, subsequent leaching may be performed to remove catalyst material from a volume beneath the recesses 314. The masking material 320 may be removed after leaching is complete.

Substantial removal of the catalyst 104 (FIG. 3) from at least a portion of the polycrystalline table 202, 302 before polishing or shaping the polycrystalline table 202 may limit or prevent damage during subsequent processing. For example, polishing or shaping the polycrystalline table 202, 302 may locally heat the material of the polycrystalline table 202, 302 (e.g., individual grains of the hard material 103 (FIG. 3)) to temperatures at which damage may occur. It is well known that high temperatures can cause damage to unleached polycrystalline diamond material, such as due to differences in the coefficients of thermal expansion of the polycrystalline diamond material itself and the catalyst, as well as back-graphitization of the diamond to carbon. By removing at least a portion of the catalyst before polishing or shaping, the localized heating of unleached polycrystalline material can be avoided. Thus, polycrystalline compacts 200, 300 formed from diamond as described herein may exhibit improved service life and/or lower rates of manufacturing defects in comparison with conventional polycrystalline diamond compacts.

Figure 9:
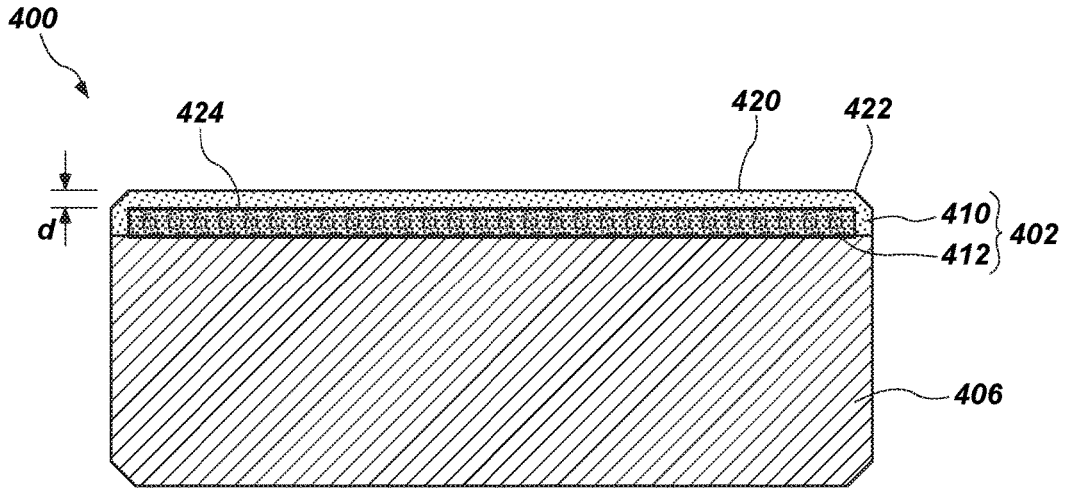
FIG. 9 is a simplified cross-section of a polycrystalline compact during processing.

FIG. 9 is a simplified cross-section of a polycrystalline compact 400 including a polycrystalline table 402 and a substrate 406. The polycrystalline table 402 includes a leached portion 410 and unleached portion 412. The leached portion 410 may be adjacent exposed surfaces of the polycrystalline table 402. Thus, the exposed surfaces of the polycrystalline table 402 may be processed as described herein (e.g., polished, shaped, etc.). For example, a surface 420 may be polished or a chamfer 422 may be formed. An interface 424 between the leached portion 410 and the unleached portion 412 of the polycrystalline table 402 may be referred to as a leach boundary, and the distance between the interface 424 and the exposed surface may be referred to as the leach depth d. The leach depth d may be, for example, from about 0.01 mm to about 1.0 mm, such as about 0.1 mm to about 0.5 mm. The leach depth d may be at least as large as a depth of material expected to experience a temperature higher than a selected threshold temperature (e.g., 500° C., 700° C., 900° C., etc.) during subsequent processing. After polishing, shaping, or otherwise processing the leached portion 410, the polycrystalline table 402 may be further leached. For example, catalyst material may subsequently be removed from the unleached portion 412 of the polycrystalline table 402.

Figure 10:
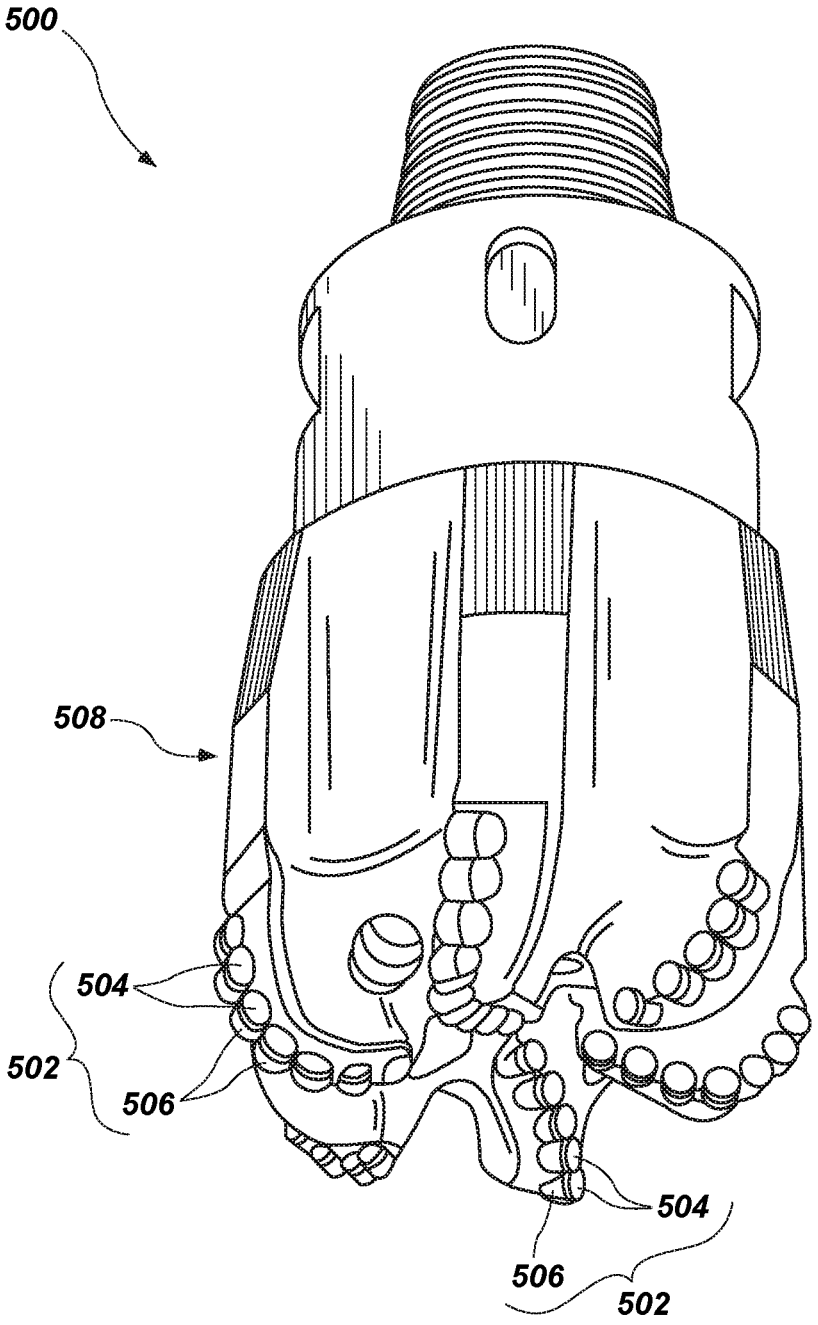
FIG. 10 is a perspective view of an embodiment of a fixed cutter earth boring rotary drill bit that includes a plurality of polycrystalline compacts like the polycrystalline compacts shown in FIGS. 2, 5, and 9.

An earth-boring tool may be formed by securing a polycrystalline cutting element formed as described herein to a bit body. As a non-limiting example, FIG. 10 illustrates a fixed cutter type earth-boring rotary drill bit 500 that includes a plurality of cutting elements 502, each of which includes a polycrystalline compact comprising polycrystalline hard material 504 on an optional substrate 506. The cutting elements 502 may be any of the polycrystalline compacts 200, 300, 400 previously described herein. The earth-boring rotary drill bit 500 includes a bit body 508, and the cutting elements 502 are bonded to the bit body 508. The cutting elements 502 may be brazed or otherwise secured within pockets formed in the outer surface of the bit body 508.

Additional non limiting example embodiments of the disclosure are described below.

Embodiment 1

A method of forming a polycrystalline compact, comprising subjecting a plurality of grains of hard material interspersed with a catalyst material to high-temperature and high-pressure conditions to form a polycrystalline material having intergranular bonds and interstitial spaces between adjacent grains of the hard material. The catalyst material is disposed in at least some of the interstitial spaces in the polycrystalline material. The method further comprises substantially removing the catalyst material from the interstitial spaces in at least a portion of the polycrystalline material to form an at least partially leached polycrystalline compact and removing a portion of the polycrystalline material from which the catalyst material has been substantially removed from the at least partially leached polycrystalline compact.

Embodiment 2

The method of Embodiment 1, wherein substantially removing the catalyst material from the interstitial spaces in at least a portion of the polycrystalline material to form an at least partially leached polycrystalline compact comprises acid-leaching the catalyst material from the interstitial spaces in the at least a portion of the polycrystalline material.

Embodiment 3

The method of Embodiment 1 or Embodiment 2, wherein substantially removing the catalyst material from the interstitial spaces in at least a portion of the polycrystalline material comprises forming an interface between a first volume of polycrystalline material and a second volume of polycrystalline material, the first volume of polycrystalline material having a first concentration of the catalyst material and the second volume of polycrystalline material having a second, substantially higher concentration of the catalyst material.

Embodiment 4

The method of Embodiment 3, wherein removing a portion of the polycrystalline material from which the catalyst material has been substantially removed from the at least partially leached polycrystalline compact comprises removing a portion of the first volume of polycrystalline material from the at least partially leached polycrystalline compact.

Embodiment 5

The method of any of Embodiments 1 through 4, further comprising substantially removing the catalyst material from the interstitial spaces in an additional portion of the polycrystalline material having substantial catalyst material therein after removing a portion of the polycrystalline material from which the catalyst material has been substantially removed from the at least partially leached polycrystalline compact.

Embodiment 6

The method of any of Embodiments 1 through 5, wherein removing a portion of the polycrystalline material from which the catalyst has been substantially removed from the at least partially leached polycrystalline compact comprises polishing at least one surface of the at least partially leached polycrystalline compact.

Embodiment 7

The method of Embodiment 6, wherein polishing at least one surface of the at least partially leached polycrystalline compact comprises polishing at least a portion of the polycrystalline material from which the catalyst material has been substantially removed to form a surface having a surface roughness less than about 10 μin. root mean square (RMS).

Embodiment 8

The method of any of Embodiments 1 through 7, wherein removing a portion of the polycrystalline material from which the catalyst material has been substantially removed from the at least partially leached polycrystalline compact comprises forming one or more non-planar areas on a front cutting face on the at least partially leached polycrystalline compact.

Embodiment 9

The method of any of Embodiments 1 through 8, wherein removing a portion of the polycrystalline material from which the catalyst material has been substantially removed from the at least partially leached polycrystalline compact comprises forming a recess extending into the polycrystalline material.

Embodiment 10

The method of any of Embodiments 1 through 9, wherein removing a portion of the polycrystalline material from which the catalyst material has been substantially removed from the at least partially leached polycrystalline compact comprises exposing the polycrystalline material to electromagnetic radiation to remove at least a portion of the polycrystalline material from which the catalyst material has been substantially removed from the at least partially leached polycrystalline compact.

Embodiment 11

The method of Embodiment 10, wherein exposing the polycrystalline material to electromagnetic radiation to remove at least a portion of the polycrystalline material from which the catalyst material has been substantially removed from the at least partially leached polycrystalline compact comprises exposing the polycrystalline material to laser irradiation.

Embodiment 12

The method of any of Embodiments 1 through 11, wherein removing a portion of the polycrystalline material from which the catalyst material has been substantially removed from the at least partially leached polycrystalline compact comprises forming a chamfer adjacent a front cutting surface of the at least partially leached polycrystalline compact.

Embodiment 13

The method of any of Embodiments 1 through 12, wherein subjecting a plurality of grains of hard material interspersed with a catalyst material to high-temperature and high-pressure conditions comprises forming a polycrystalline compact comprising polycrystalline material bonded to a substrate.

Embodiment 14

The method of any of Embodiments 1 through 13, wherein subjecting a plurality of grains of hard material interspersed with a catalyst material to high-temperature and high-pressure conditions comprises subjecting a plurality of grains of diamond interspersed with the catalyst material to high-temperature and high-pressure conditions to form polycrystalline diamond.

Embodiment 15

A method of forming an earth-boring tool, comprising forming a polycrystalline cutting element and securing the polycrystalline cutting element to a bit body. The polycrystalline cutting element is formed by subjecting a plurality of grains of hard material interspersed with a catalyst material to high-temperature and high-pressure conditions to form a polycrystalline material having intergranular bonds and interstitial spaces between adjacent grains of the hard material. The catalyst material is disposed in at least some of the interstitial spaces in the polycrystalline material. The method further comprises substantially removing the catalyst material from the interstitial spaces in at least a portion of the polycrystalline material to form an at least partially leached polycrystalline compact and removing a portion of the polycrystalline material from which the catalyst material has been substantially removed from the at least partially leached polycrystalline compact.

Embodiment 16

The method of Embodiment 15, further comprising substantially removing an additional portion of the catalyst material from the interstitial spaces in the polycrystalline material having substantial catalyst material therein after removing a portion of the polycrystalline material from which the catalyst material has been substantially removed from the at least partially leached polycrystalline compact and before securing the polycrystalline cutting element to the bit body.

Embodiment 17

The method of Embodiment 15 or Embodiment 16, wherein forming a polycrystalline cutting element comprises forming the polycrystalline material on a substrate.

Embodiment 18

The method of any of Embodiments 15 through 17, wherein removing a portion of the polycrystalline material from which the catalyst material has been substantially removed from the at least partially leached polycrystalline compact comprises forming a front cutting face comprising one or more non-planar surfaces on the at least partially leached polycrystalline compact.

Embodiment 19

A method of forming a polycrystalline diamond compact, comprising subjecting a plurality of diamond grains and a metal catalyst material to high-temperature and high-pressure conditions to form a diamond table having intergranular bonds and interstitial spaces between adjacent diamond grains. The metal catalyst material is disposed in at least some of the interstitial spaces in the diamond table. The method further comprises leaching the catalyst material from the interstitial spaces in a first portion of the diamond table to form a partially leached diamond table; mechanically removing a portion of the diamond grains from the first portion of the partially leached diamond table; and leaching the catalyst material from the interstitial spaces in a second portion of the diamond table.

Embodiment 20

The method of Embodiment 19, wherein mechanically removing a portion of the diamond grains from the first portion of the partially leached diamond table comprises polishing at least one surface of the diamond table.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors. Further, embodiments of the disclosure have utility with different and various types and configurations of cutting elements, drill bits, and other tools.

What is claimed is:

1. A method of forming a polycrystalline compact, comprising:

removing at least a portion of a catalyst material from interstitial spaces in at least a portion of a polycrystalline material having intergranular bonds between adjacent grains of hard material to form an at least partially leached polycrystalline compact, wherein the portion of polycrystalline material from which the catalyst material has been removed comprises exposed surfaces of the polycrystalline material extending across a front face and extending between the front face and a back face along a cylindrical sidewall of the polycrystalline material; and after removing the at least a portion of the catalyst material from the interstitial spaces, polishing at least a portion of the exposed surfaces of polycrystalline material from which the catalyst material has been removed from the at least partially leached polycrystalline compact to form a surface having a surface roughness less than about 10 μin root mean square (RMS).

2. The method of claim 1, wherein removing a portion of the polycrystalline material from which the catalyst material has been removed from the at least partially leached polycrystalline compact comprises forming one or more non-planar areas in the front face of the at least partially leached polycrystalline compact.

3. The method of claim 1, wherein removing a portion of the polycrystalline material from which the catalyst material has been removed from the at least partially leached polycrystalline compact comprises exposing the polycrystalline material to electromagnetic radiation to remove at least a portion of the polycrystalline material from which the catalyst material has been substantially removed from the at least partially leached polycrystalline compact.

4. The method of claim 3, wherein exposing the polycrystalline material to electromagnetic radiation to remove at least a portion of the polycrystalline material from which the catalyst material has been substantially removed from the at least partially leached polycrystalline compact comprises exposing the polycrystalline material to laser irradiation.

5. The method of claim 1, wherein removing a portion of the polycrystalline material from which the catalyst material has been removed from the at least partially leached polycrystalline compact comprises forming a chamfer adjacent the front face of the at least partially leached polycrystalline compact.

6. The method of claim 1, wherein removing at least a portion of a catalyst material from interstitial spaces in at least a portion of a polycrystalline material having intergranular bonds between adjacent grains of hard material to form an at least partially leached polycrystalline compact comprises removing at least a portion of a catalyst material from interstitial spaces in at least a portion of a polycrystalline material bonded to a substrate.

7. The method of claim 1, wherein removing at least a portion of a catalyst material from interstitial spaces in at least a portion of a polycrystalline material having intergranular bonds between adjacent grains of hard material to form an at least partially leached polycrystalline compact comprises removing at least a portion of a catalyst material from interstitial spaces in polycrystalline diamond.

8. The method of claim 1, wherein removing at least a portion of the catalyst material from the interstitial spaces in at least a portion of the polycrystalline material comprises forming an interface between a first volume of polycrystalline material and a second volume of polycrystalline material, the first volume of polycrystalline material having a first concentration of the catalyst material and the second volume of polycrystalline material having a second, substantially higher concentration of the catalyst material.

9. The method of claim 1, wherein removing a portion of the polycrystalline material from which the catalyst material has been removed from the at least partially leached polycrystalline compact comprises removing a portion of the first volume of polycrystalline material from the at least partially leached polycrystalline compact.

10. The method of claim 1, further comprising substantially removing the catalyst material from the interstitial spaces in an additional portion of the polycrystalline material having substantial catalyst material therein after removing a portion of the polycrystalline material from which the catalyst material has been substantially removed from the at least partially leached polycrystalline compact.

11. The method of claim 1, wherein removing at least a portion of the catalyst material from the interstitial spaces in at least a portion of the polycrystalline material comprises acid-leaching the catalyst material from the interstitial spaces in the at least a portion of the polycrystalline material.

12. The method of claim 1, wherein removing a portion of the polycrystalline material from which the catalyst material has been removed from the at least partially leached polycrystalline compact comprises forming a recess extending into the polycrystalline material.

13. A method of forming an earth-boring tool, comprising:

forming a polycrystalline cutting element, comprising:

removing at least a portion of a catalyst material from interstitial spaces in at least a portion of a polycrystalline material having intergranular bonds between adjacent grains of hard material to form an at least partially leached polycrystalline compact, wherein the portion of polycrystalline material from which the catalyst material has been removed comprises exposed surfaces of the polycrystalline material extending across a front face and extending between the front face and a back face along a cylindrical sidewall of the polycrystalline material; and after removing the at least a portion of the catalyst material from the interstitial spaces, polishing a portion of the exposed surfaces of polycrystalline material from which the catalyst material has been removed from the at least partially leached polycrystalline compact to form a surface having a surface roughness less than about 10 μin root mean square (RMS); and securing the polycrystalline cutting element to a bit body.

14. The method of claim 13, wherein forming a polycrystalline cutting element comprises forming the polycrystalline material on a substrate.

15. The method of claim 13, wherein removing a portion of the polycrystalline material from which the catalyst material has been removed from the at least partially leached polycrystalline compact comprises forming the front face to comprise one or more non-planar surfaces on the at least partially leached polycrystalline compact.

16. The method of claim 13, further comprising substantially removing an additional portion of the catalyst material from the interstitial spaces in the polycrystalline material having substantial catalyst material therein after removing a portion of the polycrystalline material from which the catalyst material has been substantially removed from the at least partially leached polycrystalline compact and before securing the polycrystalline cutting element to the bit body.

17. A method of forming a polycrystalline diamond compact, comprising:

leaching at least a portion of a catalyst material from interstitial spaces in a first portion of a diamond table to form a partially leached diamond table having intergranular bonds between adjacent grains of diamond, wherein the first portion of the partially leached diamond table comprises exposed surfaces of the partially leached diamond table extending across a front face and extending between the front face and a back face along a cylindrical sidewall of the partially leached diamond table;

polishing at least a portion of the exposed surfaces to remove a portion of the diamond grains from the first portion of the partially leached diamond table and form a surface having a surface roughness less than about 10 μin root mean square (RMS); and leaching the catalyst material from the interstitial spaces in a second portion of the diamond table.

* * * * *